US010762870B2

(12) United States Patent
Han et al.

(10) Patent No.: US 10,762,870 B2
(45) Date of Patent: Sep. 1, 2020

(54) ELECTRONIC DEVICE HAVING A PLURALITY OF INTERFACES AND METHOD OF DRIVING THE SAME

(71) Applicant: Samsung Display Co., Ltd., Yongin-si, Gyeonggi-do (KR)

(72) Inventors: Ho Seok Han, Yongin-si (KR); Jae Myung Jang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/427,160

(22) Filed: May 30, 2019

(65) Prior Publication Data

US 2020/0066226 A1 Feb. 27, 2020

(30) Foreign Application Priority Data

Aug. 27, 2018 (KR) ..... 10-2018-0100660

(51) Int. Cl.
*G09G 5/00* (2006.01)
*G09G 5/18* (2006.01)

(52) U.S. Cl.
CPC ..... *G09G 5/006* (2013.01); *G09G 5/18* (2013.01); *G09G 2320/103* (2013.01); *G09G 2360/18* (2013.01); *G09G 2370/00* (2013.01)

(58) Field of Classification Search
None
See application file for complete search history.

(56) References Cited

U.S. PATENT DOCUMENTS

| | | | | |
|---|---|---|---|---|
| 8,878,995 | B2 | 11/2014 | Cha et al. | |
| 9,892,483 | B2 | 2/2018 | Lee et al. | |
| 2017/0124957 | A1 | 5/2017 | Ahn et al. | |
| 2018/0033360 | A1* | 2/2018 | Bae | G09G 3/2003 |

FOREIGN PATENT DOCUMENTS

| | | | |
|---|---|---|---|
| KR | 10-2015-0055250 | A | 5/2015 |
| KR | 10-1885331 | B1 | 8/2018 |

* cited by examiner

*Primary Examiner* — Joni Hsu
(74) *Attorney, Agent, or Firm* — Lewis Roca Rothgerber Christie LLP

(57) ABSTRACT

An electronic device includes: a display driver integrated circuit (IC) configured to transmit image data to a display; and a host coupled to the display driver IC through a first interface and a second interface, wherein the host is configured to transmit the image data to the display driver IC through the first interface and transmit a mode switching signal to the display driver IC through the second interface, wherein the mode switching signal indicates whether the image data is to be transmitted in a command mode or in a video mode.

17 Claims, 5 Drawing Sheets

ELECTRONIC DEVICE HAVING A PLURALITY OF INTERFACES AND METHOD OF DRIVING THE SAME

CROSS-REFERENCE TO RELATED APPLICATION

The present application claims priority to and the benefit of Korean patent application number 10-2018-0100660 filed on Aug. 27, 2018 in the Korean Intellectual Property Office (KIPO), the entire disclosure of which is incorporated herein in its entirety by reference.

BACKGROUND

1. Field

Various embodiments of the present disclosure relate to an electronic device and a method of driving the electronic device.

2. Description of the Related Art

A Mobile Industry Processor Interface (MIPI) is a recent display standard for mobile electronic devices. MIPI supports two display modes, that is, a video mode and a command mode.

In the video mode, image data is transmitted in real time from a host to a Display Driver IC (DDI). In the video mode, the host continues to transmit the same still image to the display driver IC when an image to be transmitted to the display driver IC is a still image. Therefore, the video mode is suitable for the display of a video (moving image), but power consumption of the host is increased when a still image is displayed.

In the command mode, the initiation of transmission of image data is controlled in response to a Tearing Effect (TE) signal. When it is desired to display a still image on a display, the display driver IC periodically reads the still image stored in a frame buffer contained in the display driver IC, and transmits the read still image to the display. While a still image is displayed without being updated, image data is not transmitted from the host to the display driver IC. Therefore, in the command mode, the power consumption of the host may be decreased when a still image is displayed.

The Background section of the present Specification includes information that is intended to provide context to example embodiments, and the information in the present Background section does not necessarily constitute prior art.

SUMMARY

Various embodiments of the present disclosure relate to an electronic device and a method of driving the electronic device, and for example, to an electronic device and a method of driving the electronic device, which allow a host to transmit a mode switching signal to a display driver IC through an interface provided separately from a Mobile Industry Processor Interface (MIPI).

Further, various embodiments of the present disclosure are directed to an electronic device and a method of driving the electronic device, which allow a display driver IC to recognize the mode switching of a host through a mode switching signal received from the host and to control the display so that an image is outputted via the display depending on the switched display mode.

An embodiment of the present disclosure may provide for an electronic device. The electronic device may include a display driver IC configured to transmit image data to a display, and a host coupled to the display driver IC through a first interface and a second interface, wherein the host is configured to transmit the image data to the display driver IC through the first interface and transmit a mode switching signal to the display driver IC through the second interface, wherein the mode switching signal indicates whether the image data is to be transmitted in a command mode or in a video mode.

The host may be configured to, when the image data is still image data, transmit the mode switching signal indicating the command mode to the display driver IC, and when the image data is moving image data, transmit the mode switching signal indicating the video mode to the display driver IC.

The display driver IC may be configured to set a first path along which the image data is outputted to the display through a memory buffer in response to the mode switching signal indicating the command mode, and set a second path along which the image data is outputted to the display by bypassing the memory buffer in response to the mode switching signal indicating the video mode.

The host may be configured to, after transmitting the mode switching signal indicating the video mode, transmit the image data to the display driver IC during a high-level period of a Tearing Effect (TE) control signal, and the display driver IC may be configured to transmit the image data to the display through the second path from a time point at which the high-level period of the TE control signal ends.

The host may be configured to, after transmitting the mode switching signal indicating the command mode, transmit the image data to the display driver IC during a high-level period of a TE control signal, and the display driver IC may be configured to transmit the image data to the display through the first path from a time point at which the high-level period of the TE control signal ends.

The host may be configured to transmit moving image data to the display driver IC during at least one high-level period of the TE control signal until still image data is capable of being transmitted to the display driver IC.

The first interface may be a Mobile Industry Processor Interface (MIPI), and the second interface may be an independent transmission line different from the first interface.

An embodiment of the present disclosure may provide for a method of driving an electronic device including a display driver IC. The method may include receiving, by the display driver IC, a mode switching signal indicating whether image data is to be transmitted in a command mode or in a video mode from a host, and outputting image data to a display through a memory buffer in response to the mode switching signal indicating the command mode, and outputting the image data to the display by bypassing the memory buffer in response to the mode switching signal indicating the video mode, wherein the image data is received from the host through a first interface, and the mode switching signal is received from the host through a second interface.

The mode switching signal may indicate the command mode when the image data is still image data, and may indicate the video mode when the image data is moving image data.

Outputting the image data to the display may include, after receiving the mode switching signal indicating the video mode, receiving the image data during a high-level period of a Tearing Effect (TE) control signal, and transmitting the image data to the display by bypassing the memory buffer from a time point at which the high-level period of the TE control signal ends.

Outputting the image data to the display may include, after receiving the mode switching signal indicating the command mode, receiving the image data during a high-level period of a TE control signal, and transmitting the image data to the display through the memory buffer from a time point at which the high-level period of the TE control signal ends.

Outputting the image data to the display may include, after receiving the mode switching signal indicating the command mode, receiving moving image data during at least one high-level period of a TE control signal, receiving still image data during a subsequent high-level period of the TE control signal, and transmitting the still image data to the display through the memory buffer from a time point at which the high-level period of the TE control signal ends.

The first interface may be a Mobile Industry Processor Interface (MIPI), and the second interface may be an independent transmission line different from the first interface.

An embodiment of the present disclosure may provide for a method of driving an electronic device including a host. The method may include determining, by the host, whether image data is to be transmitted in a command mode or in a video mode based on the image data, and transmitting the image data and a mode switching signal indicating the command mode or the video mode to a display driver IC, wherein the image data is transmitted through a first interface, and the mode switching signal is transmitted through a second interface.

The mode switching signal may indicate the command mode when the image data is still image data, and may indicate the video mode when the image data is moving image data.

The method may further include, after transmitting the mode switching signal, transmitting the image data to the display driver IC during a high-level period of a TE control signal.

The method may further include, when the mode switching signal indicates the command mode, after transmitting the mode switching signal, transmitting moving image data during at least one high-level period of the TE control signal, and transmitting still image data during a subsequent high-level period of the TE control signal.

The first interface may be a Mobile Industry Processor Interface (MIPI), and the second interface may be an independent transmission line different from the first interface.

DETAILED DESCRIPTION

Figure 1:
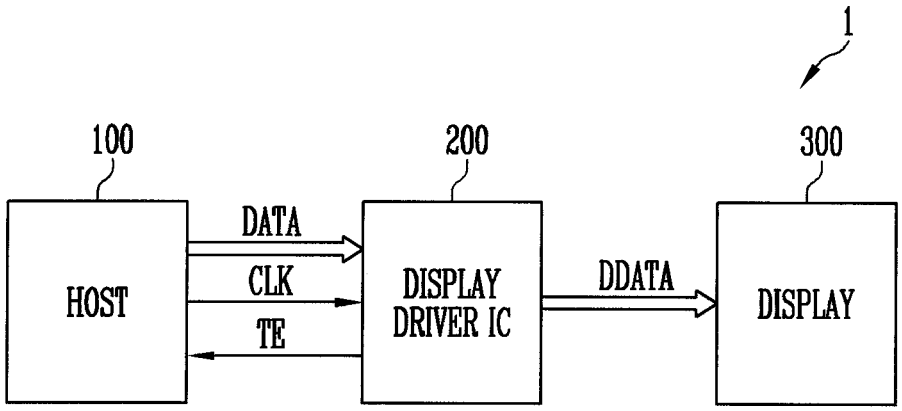
FIG. 1 is a block diagram schematically illustrating the configuration of an electronic device according to some example embodiments of the present disclosure.

Further details of various example embodiments are included in the detailed descriptions and figures.

Aspects and features of some example embodiments of the present disclosure, and methods for achieving the same will be more clear with reference to example embodiments described later in more detail together with the accompanying drawings. However, it is to be noted that the present disclosure is not limited to the example embodiments but can be embodied in various other ways. In this specification, "connected/coupled" refers to one component not only directly coupling another component but also indirectly coupling another component through an intermediate component. Furthermore, in drawings, portions unrelated to the present disclosure have been omitted to clarify the description of the present disclosure, and the same reference numerals are used throughout the different drawings to designate the same or similar components.

Hereinafter, an electronic device and a method of driving the electronic device according to some example embodiments of the present disclosure will be described in more detail with reference to the attached drawings related to the example embodiments of the present disclosure.

The electronic device according to various embodiments of the present disclosure may include at least one of, for example, a smartphone, a tablet PC, a mobile phone, a video phone, an electronic book (e-book) reader, a desktop PC, a laptop PC, a netbook computer, a workstation, a server, a Personal Digital Assistant (PDA), a Portable Multimedia Player (PMP), an MP3 player, a medical device, a camera, or a wearable device. A wearable device may include at least one of an accessory-type device (e.g., a watch, a ring, a bracelet, an anklet, a necklace, glasses, contact lenses or a head-mounted device (HMD)), a fabric or clothing integrated type device (e.g., electronic clothing), a body-mounted type device (e.g., a skin pad or a tattoo), or a bio-implantable circuit. In some embodiments, the electronic device may include at least one of, for example, a television, a Digital Video Disk (DVD) player, an audio player, a refrigerator, an air conditioner, a vacuum cleaner, an oven, a microwave oven, a washing machine, an air cleaner, a set-top box, a home automation control panel, a security control panel, a TV box (e.g., Samsung HomeSync™, Apple TV™, or Google TV™), a game console (e.g., Xbox™ and PlayStation™), an electronic dictionary, an electronic key, a camcorder, or an electronic photo frame.

In other embodiments, the electronic device may include at least one of various medical devices (e.g., various portable medical measuring devices such as a blood glucose monitoring device, a heart rate monitoring device, a blood pressure measuring device, a body temperature measuring device, a Magnetic Resonance Angiography (MRA), a Magnetic Resonance Imaging (MRI), a Computed Tomography (CT) machine, an ultrasonic machine, etc.), a navigation device, a Global Navigation Satellite System (GNSS), an Event Data Recorder (EDR), a Flight Data Recorder (FDR), a vehicle infotainment device, an electronic device for a ship (e.g., a navigation device for a ship, a gyro-compass, etc.), avionics, security devices, an automotive head unit, a robot for industry or home, a drone, an automated teller machine (ATM) in financial institutions, point of sales (POS) in shops, or Internet of Things (IoT) devices (e.g., a light bulb, various sensors, a sprinkler device, a fire alarm, a thermostat, a streetlamp, a toaster, sporting goods, a hot water tank, a heater, a boiler, etc.). In accordance with additional example embodiments of the present disclosure, the electronic device may include at least one of a part of furniture, a building/structure or vehicle, an electronic board, an electronic signature receiving device, a projector, or various types of measuring devices (e.g., a water meter, an electric meter, a gas meter, or a radio wave meter). In various embodiments, the electronic device may be flexible, and may be a combination of two or more of the above-described devices. The electronic device according to the embodiment of the present disclosure is not limited to the above-described devices.

In the present specification, the term "user" may refer to a person who uses the electronic device or a device (e.g., an artificial intelligence electronic device) which uses the electronic device.

Figure 2:
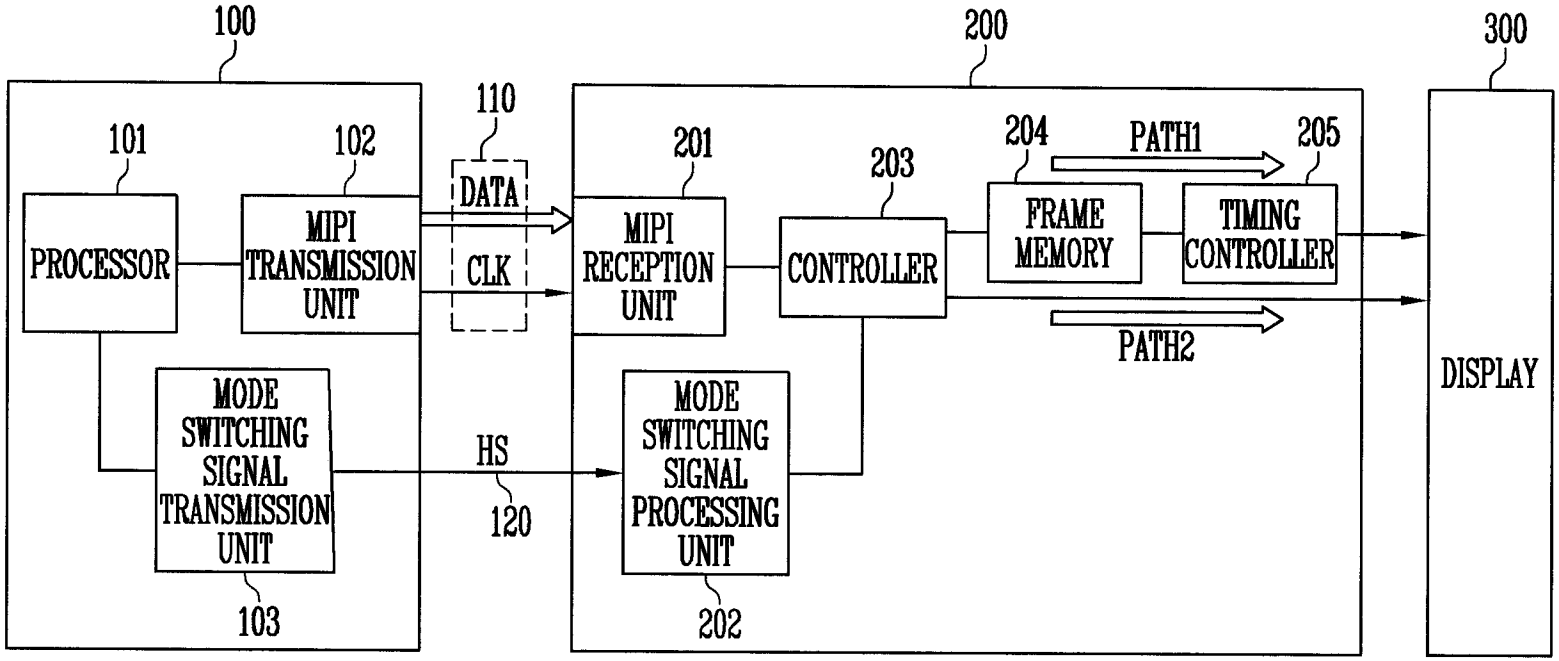
FIG. 2 is a block diagram illustrating in more detail the configuration of an electronic device according to some example embodiments of the present disclosure.
Figure 3:
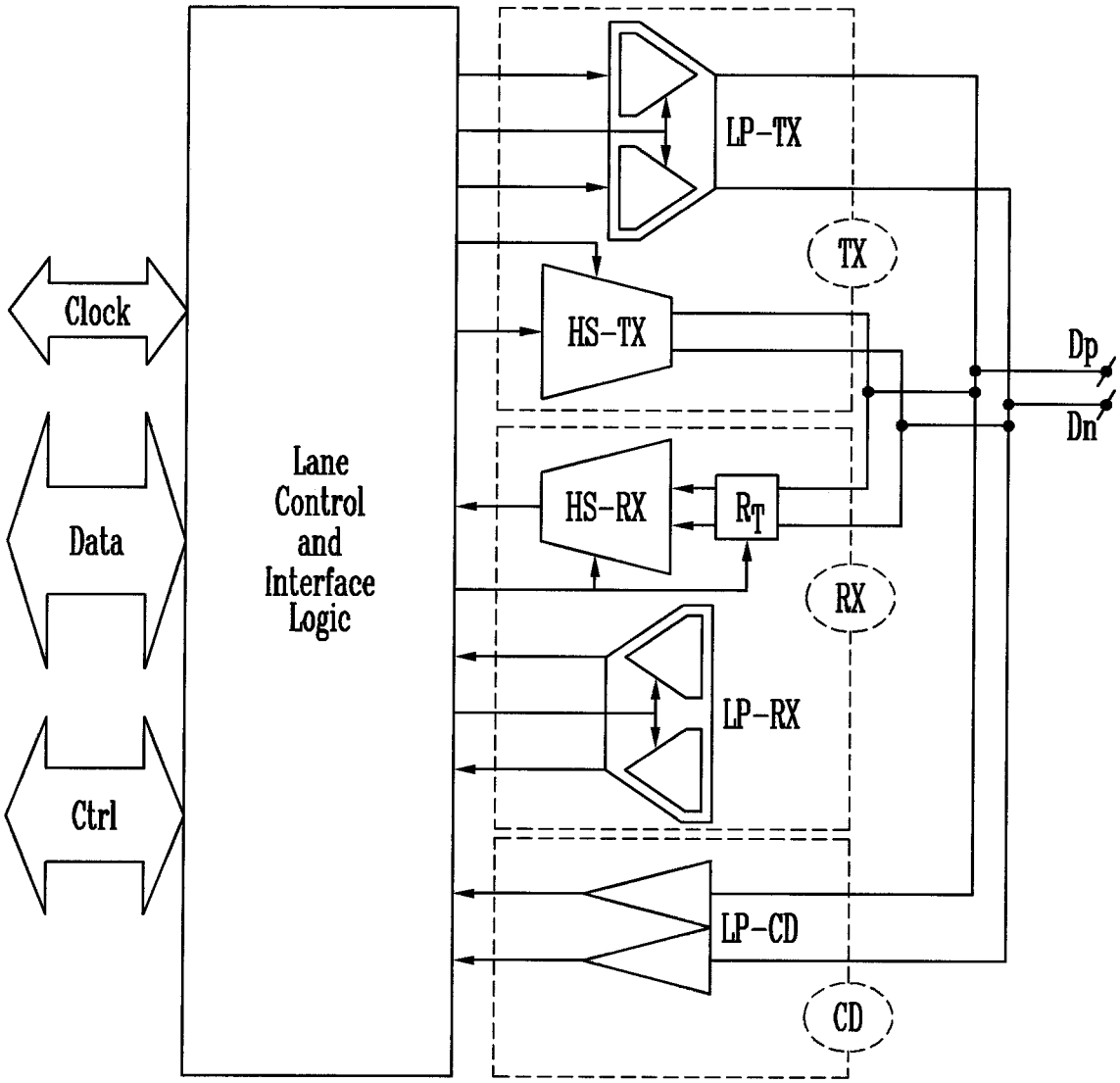
FIG. 3 is a diagram illustrating universal lane module functions of a MIPI.

FIG. 1 is a block diagram schematically illustrating the configuration of an electronic device according to the present disclosure, FIG. 2 is a block diagram illustrating in more detail the configuration of the electronic device according to the present disclosure, and FIG. 3 is a diagram illustrating universal lane module functions of a Mobile Industry Processor Interface (MIPI).

An electronic device 1 is an arbitrary device which can display a video stream, for example, a still image or a moving image, on a display 300. Referring to FIG. 1, the electronic device 1 according to some example embodiments the present disclosure may include a host 100, a display driver Integrated Circuit (IC) 200, and the display 300.

The host 100 is configured to control the operation of the display driver IC 200. In an embodiment, the host 100 may be implemented as an Integrated Circuit (IC), a System-on-Chip (SoC), an Application Processor (AP), or a mobile AP. The host 100 may include a processor 101, a MIPI transmission unit (MIPI Tx) 102, and a mode switching signal transmission unit 103.

The processor 101 may control the operations of other components constituting the host 100, for example, the MIPI transmission unit 102 and the mode switching signal transmission unit 103. The processor 101 may process image data DATA to be transmitted to the display driver IC 200 through the MIPI transmission unit 102, and may control the transmission of the processed image data DATA to the display driver IC 200.

In various embodiments of the present disclosure, the processor 101 may determine whether the image data DATA to be transmitted to the display driver IC 200 is still image data or moving image data, and may set a display mode to a command mode or a video mode based on the result of determination. Further, the processor 101 may control the transmission of the image data DATA depending on the display mode. Alternatively, when the image data DATA to be transmitted to the display driver IC 200 is moving image data, the processor 101 may transmit the image data DATA to the display driver IC 200 in real time (video mode).

The MIPI transmission unit 102 may refer to a terminal provided to transmit data from the host 100 to the display driver IC 200 based on the MIPI standard. The MIPI transmission unit 102 may transmit the image data DATA processed by the processor 101 to the display driver IC 200.

The MIPI transmission unit 102 includes one clock lane module and one or more data lane modules. As illustrated in FIG. 3, each lane module may include a high-speed transmitter HS-TX, a high-speed receiver HS-RX, a low-power transmitter LP-TX, a low-power receiver LP-RX, and a low-power contention detector LP-CD. A transmitter TX includes the LP-TX and the HS-TX, a receiver RX includes the HS-RX, the LP-RX, and a termination resistor (or termination impedance) $R_T$, and a contention detector CD includes the LP-CD. The termination resistor $R_T$ may be enabled only when the corresponding lane module is in a high-speed reception mode. The lane module of FIG. 3 has the structure of a D-Physical layer (PHY) transceiver, which may be controlled by a lane control and interface logic. In the present specification, MIPI alliance specifications may be referred to.

In some example embodiments according to the present disclosure, an example in which the host 100 includes the MIPI transmission unit 102 is described, but the host 100 may include a transmission unit using various standards, such as a Mobile Display Digital Interface (MDDI), a display port, and an embedded display port, in addition to the MIPI standard.

The mode switching signal transmission unit 103 generates a mode switching signal HS for indicating the display mode for image data DATA, for example, the command mode or the video mode, and transmits the mode switching signal HS to the display driver IC 200. In an example, the mode switching signal HS may be designated to have a logic 1 or a logic high level in response to the command mode and to have a logic 0 or a logic low level in response to the video mode, and vice versa. In an example, when the mode switching signal HS has a packet structure, the mode switching signal HS may be configured to include a field for storing a parameter indicating the display mode.

In the present specification, although the mode switching signal transmission unit 103 is described as being provided separately from the processor 101, the mode switching signal transmission unit 103 may be integrated with the processor 101 into a single component.

The host 100 and the display driver IC 200 may communicate with each other through a first interface 110. In various embodiments of the present disclosure, the first interface 110 is an MIPI interface which couples the MIPI transmission unit 102 of the host 100 to a MIPI reception unit 201 of the display driver IC 200, and includes one clock lane and one or more data lanes. The clock lane transmits a clock signal CLK, having different frequencies and different swing levels depending on the operating mode (e.g., a low-power (LP) mode and a high-speed (HS) mode), to the display driver IC 200. Each data lane transmits image data DATA, having different frequencies and different swing levels depending on the operating mode, to the display driver IC 200.

Further, in various embodiments of the present disclosure, the host 100 and the display driver IC 200 may communicate with each other through a second interface 120. The second interface 120 is an independent interface (transmission line) provided separately from the first interface 110 (i.e., MIPI interface), is different from the first interface 110, and does not conform to a MIPI standard. The second interface 120 is an exclusive line for transmitting the mode switching signal HS from the host 100.

The display driver IC 200 may process the image data DATA received from the host 100 through the first interface 110, and may control the display 300 so that an image corresponding to the processed result is displayed on the display 300. Here, the display driver IC 200 may select any one of a command mode processing path PATH1 and a video mode processing path PATH2 implemented in the display driver IC 200 in response to the mode switching signal HS received from the host 100 through the second interface 120, and may transmit the processed image data DATA as output image data DDATA to the display 300.

The display driver IC 200 may include the MIPI reception unit (MIPI Rx) 201, a mode switching signal processing unit 202, a controller 203, a frame memory (i.e., a memory buffer) 204, and a timing controller 205.

The MIPI reception unit 201 may receive the clock signal CLK and the image data DATA from the host 100 through the first interface 110, and may transfer the clock signal CLK and the image data DATA to the controller 203. The MIPI reception unit 201 includes one clock lane module and one or more data lane modules. As illustrated in FIG. 3, each lane module includes HS-TX, HS-RX, LP-TX, LP-RX, and LP-CD.

The mode switching signal processing unit 202 may receive the mode switching signal HS from the host 100 through the second interface 120, process the received mode switching signal HS, and transfer the processed mode switching signal HS to the controller 203. In various embodiments, the mode switching signal processing unit 202 may include a mode switching sampler (not illustrated) configured to process noise in the mode switching signal HS and verify the validity of the mode switching signal HS at a physical level, and a mode switching logic unit (not illustrated) configured to, when it is determined that the mode switching signal HS is valid, analyze the display mode indicated by the mode switching signal HS, and transfer a signal corresponding to analyzed display mode to the controller 203.

The controller 203 may generate output image data DDATA by processing the image data DATA. In various embodiments of the present disclosure, the controller 203 may identify, based on the mode switching signal HS, whether the display mode is a command mode or a video mode, and may determine whether to transmit the output image data DDATA to the display 300 through the frame memory 204 (command mode) or whether to transmit the output image data DDATA to the display 300 by bypassing the frame memory 204 (video mode). For example, when the display mode indicates the command mode in response to the mode switching signal HS, the controller 203 may transmit the output image data DDATA to the display 300 through the command mode processing path PATH1 which passes through the frame memory 204, whereas when the display mode indicates the video mode in response to the mode switching signal HS, the controller 203 may transmit the output image data DDATA to the display 300 through the video mode processing path PATH2 which does not pass through the frame memory 204.

The frame memory 204 receives and stores the output image data DDATA under the control of the controller 203. For example, the frame memory 204 may be implemented as a graphic memory. In an embodiment, a write operation and a read operation of the frame memory 204 may be controlled by the timing controller 205. In an example, the timing controller 205 may read data from the frame memory 204 during a high-level period of a frame scan signal Frame_Scan.

The timing controller 205 may generate a Tearing Effect (TE) control signal TE, and may transmit the generated TE control signal TE to the host 100. The processor 101 of the host 100 may monitor the TE control signal TE, and may control the transmission timing of the image data DATA based on the result of monitoring.

The display 300 may display an image corresponding to the output image data DDATA transmitted from the display driver IC 200. The display 300 may be implemented as a liquid crystal display (LCD), a light-emitting diode (LED) display, an organic LED (OLED) display, or an active-matrix OLED (AMOLED) display.

In various embodiments of the present disclosure, the display driver IC 200 and the display 300 may be integrated into a single display device.

Figure 4:
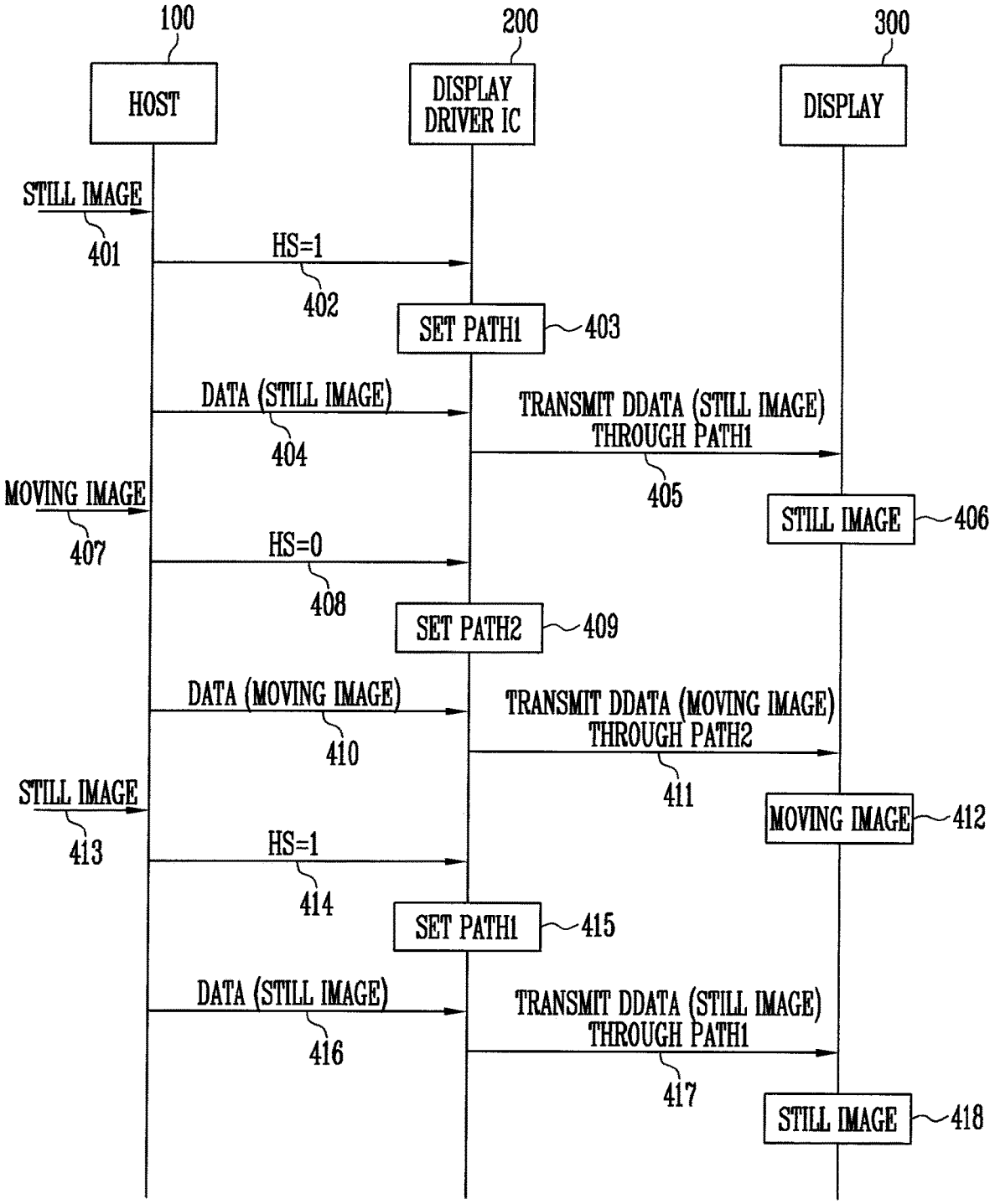
FIG. 4 is a flowchart illustrating a method of driving an electronic device according to some example embodiments of the present disclosure.
Figure 5:
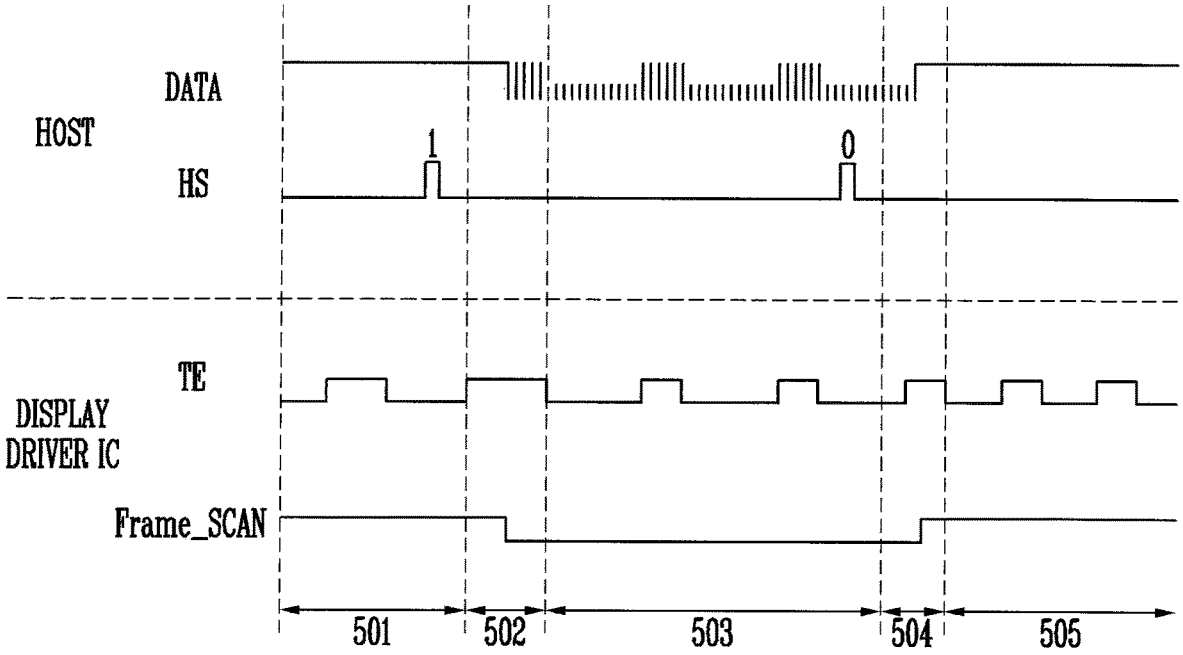
FIG. 5 is a timing diagram of the method of driving an electronic device according to some example embodiments of the present disclosure.

FIG. 4 is a flowchart illustrating a method of driving an electronic device according to some example embodiments of the present disclosure, and FIG. 5 is a timing diagram of the method of driving an electronic device according to some example embodiments of the present disclosure. Below, a process in which still image data, moving image data, and still image data are sequentially displayed on the display device 300 will be described with reference to FIGS. 4 and 5.

When a host 100 desires to transmit still image data to a display driver IC 200 at step 401, a mode switching signal transmission unit 103 sets a mode switching signal HS to a logic '1' or a logic high level, and transmits the mode switching signal HS to the display driver IC 200 through a second interface 120 at step 402. The mode switching signal processing unit 202 of the display driver IC 200 processes the mode switching signal HS received through the second interface 120 and transfers the processed mode switching signal HS to the controller 203. The controller 203 sets a command mode processing path PATH1 in response to the mode switching signal HS at step 403.

Thereafter, the host 100 transmits image data DATA including still image data to the display driver IC 200 through a first interface 110 at step 404. The image data DATA received from the host 100 is transmitted, as output image data DDATA, from the display driver IC 200 to the display 300 through the command mode processing path PATH1 at step 405. The display 300 processes the output image data DDATA, and then displays a still image at step 406. During a command mode (501 of FIG. 5) defined in response to the mode switching signal HS, the still image is displayed on the display 300. While the still image is not updated, the host 100 does not additionally transmit a still image to the display driver IC 200, and the display driver IC 200 may periodically read the output image data DDATA, prestored in a frame memory 204, and may transmit the output image data DDATA to the display 300.

When the host 100 desires to transmit moving image data to the display driver IC 200 at step 407, the processor 101 sets the mode switching signal HS to a logic '0' or a logic low level and transmits the mode switching signal HS to the display driver IC 200 through the second interface 120 at step 408. In the illustrated embodiment, although the host 100 transmits the mode switching signal HS regardless of the TE control signal TE, the host 100 may transmit the mode switching signal HS during a high-level period of the TE control signal TE so as to prevent or reduce abnormal displaying on the display 300 in various embodiments of the present disclosure.

The mode switching signal processing unit 202 of the display driver IC 200 processes the mode switching signal HS received through the second interface 120 and transfers the processed mode switching signal HS to the controller 203. The controller 203 sets a video mode processing path PATH2 in response to the mode switching signal HS at step 409.

During a high-level period (502 of FIG. 5) of the TE control signal TE after transmitting the mode switching signal HS, the host 100 transmits the image data DATA including moving image data to the display driver IC 200 at step 410. Further, during the high-level period 502 of the TE control signal TE, the display driver IC 200 may switch the display mode from the command mode to the video mode. During the high-level period 502 of the TE control signal TE, the display 300 maintains the display state of the still image data of a previous frame.

From a time point at which the high-level period 502 of the TE control signal TE ends, that is, from the falling edge of the TE control signal TE, the display driver IC 200 may immediately transmit the image data DATA of a video image, received from the host 100 during the high-level period 502 of the TE control signal TE, to the display 300 through the video mode processing path PATH2 at step 411. Therefore, the display 300 may seamlessly display the moving image data even if the mode changes at step 412.

During the video mode (503 of FIG. 5) defined in response to the mode switching signal HS, the host 100 transmits the image data DATA including the moving image data to the display driver IC 200 through the first interface 110. The image data DATA received from the host 100 is transmitted, as output image data DDATA, from the display driver IC 200 to the display 300 through the video mode processing path PATH2. The display 300 processes the output image data DDATA, and then displays a moving image.

When the host 100 desires to transmit still image data subsequent to the moving image data to the display 300 at step 413, the processor 101 sets the mode switching signal HS to a logic '1' or a logic high level and transmits the mode switching signal HS to the display driver IC 200 through the second interface 120 at step 414. In the illustrated embodiment, although the host 100 transmits the mode switching signal HS regardless of the TE control signal TE, the host 100 may transmit the mode switching signal HS during a high-level period of the TE control signal TE so as to prevent or reduce abnormal displaying on the display 300 in various embodiments of the present disclosure.

The mode switching signal processing unit 202 of the display driver IC 200 processes the mode switching signal HS received through the second interface 120 and transfers the processed mode switching signal HS to the controller 203. The controller 203 sets the video mode processing path PATH2 in response to the mode switching signal HS at step 415.

In order to correctly perform switching to the command mode, output image data DDATA corresponding to still images must be written to the frame memory 204 before the frame memory 204 is loaded. Therefore, during a high-level period (504 of FIG. 5) of the TE control signal TE after transmitting the mode switching signal HS, the host 100 transmits the image data DATA including still image data to the display driver IC 200 at step 416. Further, during the high-level period 504 of the TE control signal TE, the display driver IC 200 may switch the display mode from the video mode to the command mode. During the high-level period 504 of the TE control signal TE, the display 300 maintains the display state of the moving image data of a previous frame.

In an embodiment, when still image data cannot be transmitted during a first high-level period of the TE control signal TE after transmitting the mode switching signal HS, the host 100 may continue to transmit moving image data to the display driver IC 200 during a high-level period of the TE control signal TE of at least one frame until still image data can be transmitted.

After the high-level period 504 of the TE control signal TE, the display driver IC 200 may immediately transmit the image data DATA of a still image, received from the host 100 during the high-level period 504 of the TE control signal TE, to the display 300 through the command mode processing path PATH1 at step 417.

During the video mode (e.g., 505 of FIG. 5) defined in response to the mode switching signal HS, the host 100 transmits the image data DATA including the still image data to the display driver IC 200 through the first interface 110. The image data DATA received from the host 100 is transmitted, as output image data DDATA, from the display driver IC 200 to the display 300 through the command mode processing path PATH1. The display 300 processes the output image data DDATA, and then displays a still image at step 418.

The electronic device and the method of driving the electronic device according to the present disclosure enable seamless switching between a video mode and a command mode in electronic devices which conform to a MIPI standard.

Further, the electronic device and the method of driving the electronic device according to the present disclosure allow a display driver IC to determine whether to output an image in a video mode or in a command mode based on a mode switching signal transmitted from a host, thus decreasing the power consumption of the display driver IC.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Those skilled in the art to which the present disclosure pertains will understand that the present disclosure may be practiced in other detailed forms without departing from the technical spirit or essential features thereof. Therefore, it should be understood that the above-described embodiments are only examples in all aspects rather than being restrictive. It is intended that the scope of the present disclosure should be defined by the accompanying claims rather than the above-described descriptions, and various modifications, additions and substitutions, which can be derived from the meaning, scope and equivalent concepts of the accompanying claims, and their equivalents, fall within the scope of the present disclosure.

What is claimed is:

1. An electronic device, comprising:

a display driver integrated circuit (IC) configured to transmit image data to a display; and a host coupled to the display driver IC through a first interface and a second interface, wherein the host is configured to transmit the image data to the display driver IC through the first interface and transmit a mode switching signal to the display driver IC through the second interface, wherein the mode switching signal indicates whether the image data is to be transmitted in a command mode or in a video mode, wherein the host is configured to transmit moving image data to the display driver IC during at least one high-level period of a Tearing Effect (TE) control signal until still image data is capable of being transmitted to the display driver IC.

2. The electronic device according to claim 1, wherein the host is configured to, when the image data is still image data, transmit the mode switching signal indicating the command mode to the display driver IC, and when the image data is moving image data, transmit the mode switching signal indicating the video mode to the display driver IC.

3. The electronic device according to claim 1, wherein the display driver IC is configured to set a first path along which the image data is output to the display through a memory buffer in response to the mode switching signal indicating the command mode, and set a second path along which the image data is output to the display by bypassing the memory buffer in response to the mode switching signal indicating the video mode.

4. The electronic device according to claim 3, wherein:

the host is configured to, after transmitting the mode switching signal indicating the video mode, transmit the image data to the display driver IC during a high-level period of the TE control signal, and the display driver IC is configured to transmit the image data to the display through the second path from a time point at which the high-level period of the TE control signal ends.

5. The electronic device according to claim 3, wherein:

the host is configured to, after transmitting the mode switching signal indicating the command mode, transmit the image data to the display driver IC during a high-level period of the TE control signal, and the display driver IC is configured to transmit the image data to the display through the first path from a time point at which the high-level period of the TE control signal ends.

6. The electronic device according to claim 1, wherein:

the first interface is an interface supporting a video mode and a command mode, and the second interface is an independent transmission line different from the first interface.

7. A method of driving an electronic device including a display driver integrated circuit (IC), the method comprising:

receiving, by the display driver IC, a mode switching signal indicating whether image data is to be transmitted in a command mode or in a video mode from a host;

outputting image data to a display through a memory buffer in response to the mode switching signal indicating the command mode, and outputting the image data to the display by bypassing the memory buffer in response to the mode switching signal indicating the video mode, wherein the image data is received from the host through a first interface, and the mode switching signal is received from the host through a second interface; and transmitting, by the host, moving image data to the display driver IC during at least one high-level period of a Tearing Effect (TE) control signal until still image data is capable of being transmitted to the display driver IC.

8. The method according to claim 7, wherein the mode switching signal indicates the command mode when the image data is still image data, and indicates the video mode when the image data is moving image data.

9. The method according to claim 7, wherein outputting the image data to the display comprises:

after receiving the mode switching signal indicating the video mode, receiving the image data during a high-level period of the TE control signal; and transmitting the image data to the display by bypassing the memory buffer from a time point at which the high-level period of the TE control signal ends.

10. The method according to claim 7, wherein outputting the image data to the display comprises:

after receiving the mode switching signal indicating the command mode, receiving the image data during a high-level period of the TE control signal; and transmitting the image data to the display through the memory buffer from a time point at which the high-level period of the TE control signal ends.

11. The method according to claim 7, wherein outputting the image data to the display comprises:

after receiving the mode switching signal indicating the command mode, receiving moving image data during at least one high-level period of the TE control signal;

receiving still image data during a subsequent high-level period of the TE control signal; and transmitting the still image data to the display through the memory buffer from a time point at which the high-level period of the TE control signal ends.

12. The method according to claim 7, wherein:

the first interface is an interface supporting a video mode and a command mode, and the second interface is an independent transmission line different from the first interface.

13. A method of driving an electronic device including a host, comprising:

determining, by the host, whether or not image data is to be transmitted in a command mode or in a video mode based on the image data; and transmitting the image data and a mode switching signal indicating the command mode or the video mode to a display driver integrated circuit (IC), wherein the image data is transmitted through a first interface, and the mode switching signal is transmitted through a second interface; and transmitting, by the host, moving image data to the display driver IC during at least one high-level period of a Tearing Effect (TE) control signal until still image data is capable of being transmitted to the display driver IC.

14. The method according to claim 13, wherein the mode switching signal indicates the command mode when the image data is still image data, and indicates the video mode when the image data is moving image data.

15. The method according to claim 13, further comprising, after transmitting the mode switching signal:

transmitting the image data to the display driver IC during a high-level period of the TE control signal.

16. The method according to claim 15, further comprising, when the mode switching signal indicates the command mode:

after transmitting the mode switching signal, transmitting moving image data during at least one high-level period of the TE control signal; and transmitting still image data during a subsequent high-level period of the TE control signal.

17. The method according to claim 13, wherein:

the first interface is an interface supporting a video mode and a command mode, and the second interface is an independent transmission line different from the first interface.

* * * * *